US007563357B2

(12) United States Patent
Keusenkothen et al.

(10) Patent No.: US 7,563,357 B2
(45) Date of Patent: Jul. 21, 2009

(54) PROCESS FOR CRACKING SYNTHETIC CRUDE OIL-CONTAINING FEEDSTOCK

(75) Inventors: Paul F Keusenkothen, Houston, TX (US); James N McCoy, Houston, TX (US); James Earl Graham, Baytown, TX (US); Chad David Reimann, Fairfax, VA (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 203 days.

(21) Appl. No.: 11/698,514

(22) Filed: Jan. 26, 2007

(65) Prior Publication Data

US 2008/0179218 A1 Jul. 31, 2008

(51) Int. Cl.
*C10G 9/14* (2006.01)

(52) U.S. Cl. ..... 208/14; 208/61; 208/68; 208/80; 208/86; 208/89; 208/106; 585/921; 202/153; 196/100; 196/139

(58) Field of Classification Search ..... 208/14, 208/61, 68, 80, 86, 89, 106; 196/100, 139; 202/153; 585/921
See application file for complete search history.

(56) References Cited

U.S. PATENT DOCUMENTS

| | | | | |
|---|---|---|---|---|
| 3,647,907 | A | 3/1972 | Sato et al. | |
| 4,176,045 | A | 11/1979 | Leftin et al. | |
| 4,954,240 | A | 9/1990 | Eidt, Jr. | |
| 6,274,003 | B1 * | 8/2001 | Friday et al. | 196/100 |
| 2005/0258073 | A1 | 11/2005 | Oballa et al. | |

FOREIGN PATENT DOCUMENTS

| | | |
|---|---|---|
| DE | 243 708 | 3/1987 |
| DE | 255 540 | 4/1988 |
| EP | 0 504 523 | 9/1992 |

OTHER PUBLICATIONS

"High Severity Pyrolysis of Shale and Petroleum Gas Oil Mixtures," Leftin et al., Ind. Eng. Chem. Process Des. Dev. 25, 211-216, 1986.
"Steam cracking of coal-derived liquids and some aromatic compounds in the presence of haematite," Sharypov et al., Fuel, vol. 75, No. 7, pp. 791-794, 1996.
"Petroleum residue and heavy coal liquid processing with water-steam in the presence of hematite catalyst," Kuznetsov et al., Pr. Nauk, Inst. Chem. Technol. Nafty Wegla Politech. Wroclaw, 101-106, 1999 (Abstract only).
"Pyrolysis of coal-derived naphtha," Sh et al., Azerb. Neft. Khoz., (5) 37-40, 1989 (Abstract only).
"Kinetic Simulation Model for Steam Pyrolysis of Shale Oil Feedstock," Kavianian et al., Ind. Eng. Chem. Res. 29, 527-534, 1990.
"Use of hydrogenated fushun shale oil as a steam pyrolysis feedstock," Dong et al., Shiyou Xuebao, Shiyou Jiagong, 3(3)99-104, 1987 (Abstract only).

* cited by examiner

*Primary Examiner*—Glenn Caldarola
*Assistant Examiner*—Prem C. Singh

(57) ABSTRACT

A process for steam cracking liquid hydrocarbon feedstocks containing synthetic crude oil comprises i) hydroprocessing a wide boiling range aliquot containing a) normally liquid hydrocarbon portion substantially free of resids and b) thermally cracked hydrocarbon liquid, boiling in a range from about 600° to about 1050° F., to provide a synthetic crude oil substantially free of resids; ii) adding to the synthetic crude oil a normally liquid hydrocarbon component boiling in a range from about 100° to about 1050° F.; and iii) cracking the mixture resulting from ii) in a cracker furnace comprising a radiant coil outlet to provide a cracked effluent, wherein the cracking is carried out under conditions sufficient to effect a radiant coil outlet temperature which is greater than the optimum radiant coil outlet temperature for cracking the synthetic crude oil separately. A method for upgrading synthetic crude for use in cracking is also provided, as well as a feedstock for cracking.

31 Claims, No Drawings

PROCESS FOR CRACKING SYNTHETIC CRUDE OIL-CONTAINING FEEDSTOCK

FIELD

The present invention is directed to a method for processing the gaseous effluent from hydrocarbon pyrolysis units that can use heavy feeds, e.g., synthetic crude oil-containing feeds, as well as a method to upgrade synthetic crude oils.

BACKGROUND

Steam cracking, also referred to as pyrolysis, has long been used to crack various hydrocarbon feedstocks into olefins, preferably light olefins such as ethylene, propylene, and butenes. Conventional steam cracking utilizes a pyrolysis furnace which has two main sections: a convection section and a radiant section. The hydrocarbon feedstock typically enters the convection section of the furnace as a liquid (except for light feedstocks which enter as a vapor) wherein it is typically heated and vaporized by indirect contact with hot flue gas from the radiant section and by direct contact with steam. The vaporized feedstock and steam mixture is then introduced into the radiant section where the cracking takes place. The resulting products, including olefins, leave the pyrolysis furnace for further downstream processing, including quenching.

Historically, quenching effluent from a heavy feed cracking furnace has been technically challenging. Most modern heavy feed furnaces employ a two-stage quench, the first stage being a high pressure 10400 to 13900 kPa (1500-2000 psig) steam generator and the second stage utilizing direct oil quench injection. See, e.g., U.S. Pat. No. 3,647,907 to Sato et al., incorporated herein by reference. In the 1960s high pressure steam generating cracked gas coolers deployed as transfer line exchangers were found to be especially useful in cracking liquid feeds. The high steam pressure (8100 to 12200 kPa (80 to 120 bar)) and high tube wall temperatures (300° to 350° C.) limited the condensation of heavy hydrocarbons and attendant coke formation on tube surfaces.

Conventional steam cracking systems have been effective for cracking high-quality feedstocks such as gas oil and naphtha. However, steam cracking economics sometimes favor cracking low cost heavy feedstock such as, by way of non-limiting examples, crude oil and atmospheric resid, also known as atmospheric pipestill bottoms. Crude oil and atmospheric resid contain high molecular weight, non-volatile components with boiling points in excess of 590° C. (1100° F.). The non-volatile, heavy ends of these feedstocks lay down as coke in the convection section of conventional pyrolysis furnaces. Only very low levels of non-volatiles can be tolerated in the convection section downstream of the point where the lighter components have fully vaporized. Additionally, some naphthas are contaminated with crude oil during transport. Conventional pyrolysis furnaces do not have the flexibility to process resids, crudes, or many resid or crude contaminated gas oils or naphthas, which contain a large fraction of heavy non-volatile hydrocarbons.

Synthetic crude oils are wide boiling range hydrocarbon feeds that contain minimal amounts of non-volatile materials. Given the substantial absence of non-volatiles, e.g., resids (including asphaltenes), from synthetic crudes, they appear particularly suitable as feeds for cracking processes. However, conventional synthetic crudes that are hydrotreated blends of non resid containing virgin liquids from atmospheric or vacuum pipestills, combined with thermally cracked products, may exhibit difficulties in cracker operability. Such difficulties include low coil outlet temperatures, low conversion and high coking in the radiant and quench sections of pyrolysis furnaces.

U.S. Pat. No. 4,176,045 to Leftin et al., which is incorporated herein by reference, discloses production of $C_2$ to $C_5$ olefins by "steam pyrolysis, i.e., cracking" of normally liquid hydrocarbons while minimizing coke deposits on the interior surface of the furnace. More highly aromatic, higher coking petroleum derived feedstocks are blended with lower coking petroleum derived feedstocks to provide cracking feedstock.

Leftin, et al., "High-Severity Pyrolysis of Shale and Petroleum Gas Oil Mixtures," *Ind. Eng. Chem., Process Des. Dev.*, Vol. 25, No. 1, pp. 211-16, January, 1986, teach high-severity pyrolysis of narrow boiling range shale gas oil and petroleum-derived light gas oil mixtures to reduce coking rates as compared to shale gas oil alone as an alternative to hydrotreating shale gas oil prior to pyrolysis.

US 2005/0258073 to Oballa et al. discloses that "[a]n aromatics/naphthalene rich stream obtained by processing heavy gas oil derived from tar sands and cycle oils derived from cracking heavy gas oil may optionally be blended and subjected to a hydrogenation process and a ring opening reaction" in the presence of a catalyst "to produce paraffinic feedstocks for further chemical processing."

Sharypov, V. I., et al., Fuel, Vol. 75, No. 7, pp. 791-94, discloses steam cracking coal-derived liquids with b.p.<350° C.

Gamidov, et al., "Pyrolysis of Coal-Derived Naphtha," Azerb. Neftr. Khoz., (5) 37-40 (1989) Chem. Abstr. ABSTR. NO. 39538 V112 N6, teaches steam cracking a coal-derived hydrorefined naphtha provides reduced gaseous product yield (7-20%) than that of a straight-run petroleum naphtha, with the difference widening as severity of the process decreases. Ethylene yields were 3 to 7% higher for coal-derived naphtha under "medium high-severity conditions."

When using synthetic crude oils as a feedstock to a cracker, it would be desirable to upgrade such feedstocks to improve cracker operability. Such improved feedstocks should provide higher coil outlet temperatures, higher conversion and reduced coking in the radiant and quench sections of pyrolysis furnaces.

SUMMARY

In one aspect, the present invention relates to a process for cracking a synthetic crude oil-containing feedstock comprising: i) hydroprocessing a wide boiling range aliquot containing a) normally liquid hydrocarbon portion boiling in a range from about 50° to about 800° F., substantially free of resids, and b) thermally cracked hydrocarbon liquid boiling in a range from about 600° to about 1050° F., to provide a synthetic crude oil boiling in a range of from about 73° to about 1070° F., containing greater than about 25 wt % aromatics, greater than about 25 wt % naphthenes, less than about 0.3 wt % S, less than about 0.02 wt % asphaltenes, and substantially free of resids other than asphaltenes; ii) adding to the synthetic crude oil a normally liquid hydrocarbon component boiling in a range from about 100° to about 1050° F.; and iii) cracking the mixture resulting from ii) in a cracker furnace comprising a radiant coil outlet to provide a cracked effluent, wherein the cracking is carried out under conditions sufficient to effect a radiant coil outlet temperature which is greater than the optimum radiant coil outlet temperature for cracking the synthetic crude oil separately.

In certain embodiments of this aspect, the normally liquid hydrocarbon component has a greater optimum radiant coil outlet temperature than the synthetic crude oil. Typically, the normally liquid hydrocarbon component is added to the synthetic crude oil in an amount sufficient to increase at least one of A) cracked effluent temperature at the coil outlet by from about 5° to about 150° F., say, from about 50° to about 70° F., e.g., from about 100° to about 125° F., and B) olefin yields resulting from the cracking, as compared to the synthetic crude oil alone.

Embodiments of this aspect can include those wherein the normally liquid hydrocarbon component is selected from the group consisting of light virgin naphtha, condensate, kerosene, distillate, heavy atmospheric gas oil, virgin gas oil, hydrotreated gofinate, and hydrocrackate. Typically, the normally liquid hydrocarbon component is selected from the group consisting of light virgin naphtha and gas oil. Alternately, the normally liquid hydrocarbon component is selected from the group consisting of hydrotreated light virgin naphtha and hydrotreated gas oil.

In certain embodiments of this aspect of the present invention, the synthetic crude oil has a pour point no greater than about 80° F., typically no greater than about 70° F., e.g., no greater than about 52° F., say, about −12° F., while the normally liquid hydrocarbon component has a pour point greater than about 50° F., say, greater than about 102° F., e.g., greater than about 120° F., and the mixture resulting from ii) has a pour point no greater than about 100° F., say, no greater than about 90° F., e.g., no greater than about 80° F.

Embodiments of this aspect of the invention can comprise the process wherein the mixture comprises from about 1 to about 99 wt % normally liquid hydrocarbon component and from about 1 to about 99 wt % synthetic crude oil, typically from about 50 to about 80 wt % normally liquid hydrocarbon component and from about 20 to about 50 wt % synthetic crude oil, e.g., about 75 wt % hydrocrackate and 25 wt % synthetic crude oil.

In one embodiment of this aspect, the normally liquid hydrocarbon component is added to the synthetic crude oil in an amount sufficient to reduce the pour point of the mixture resulting from ii). The pour point can be reduced by at least about 5° F., typically at least about 10° F.

Certain embodiments of this aspect of the invention include those wherein the normally liquid hydrocarbon portion is a virgin refinery feed selected from the group consisting of light virgin naphtha, condensate, kerosene, distillate, heavy atmospheric gas oil, and vacuum gas oil, and the thermally cracked hydrocarbon liquid is selected from the group consisting of thermally cracked very heavy crude and coker gas oil.

Other embodiments of this aspect include those wherein the normally liquid hydrocarbon portion is a hydrotreated refinery stream selected from the group consisting of gofinate and hydrocrackate, and the thermally cracked hydrocarbon liquid is selected from the group consisting of thermally cracked very heavy crude and coker gas oil.

In another embodiment, the normally liquid hydrocarbon portion comprises light virgin napththa condensate, and the thermally cracked hydrocarbon liquid comprises thermally cracked very heavy crude.

Certain embodiments of this aspect of the invention include those wherein the hydroprocessing is selected from hydrotreating, hydrogenating and hydrocracking.

Additional embodiments of this aspect of the invention include those wherein the synthetic crude oil contains no greater than about 0.1 wt % S, e.g., no greater than about 0.05 wt % S.

In still other embodiments of this aspect, the normally liquid hydrocarbon component is added to the synthetic crude oil in an amount sufficient to provide an optimum coil outlet temperature of the cracker furnace for the resulting mixture which is increased by at least about 10° F., typically at least about 30° F., e.g., at least about 70° F., over the optimum coil outlet temperature of the cracker furnace for synthetic crude oil alone.

In another embodiment of this aspect of the invention, the normally liquid hydrocarbon component is added to the synthetic crude oil in an amount sufficient to increase the hot cracked effluent temperature at the coil outlet of the cracker furnace to the optimum coil outlet temperature for the normally liquid hydrocarbon component. Typically, the normally liquid hydrocarbon component is added to the synthetic crude oil in an amount sufficient to increase severity by at least about 0.05 C3=/C1 for each 5° F. increase in coil outlet temperature., e.g., in an amount sufficient to increase severity by at least about 0.03 C3=/C1 for each 5° F. increase in coil outlet temperature.

In still another embodiment of this aspect, the normally liquid hydrocarbon component is added to the synthetic crude oil in an amount sufficient to reduce coke make, by at least about 1 wt %, typically at least about 10 wt %, e.g., up to about 20 wt %.

In another embodiment of this aspect of the invention, the normally liquid hydrocarbon component is added to the synthetic crude oil in an amount sufficient to increase olefin yields from cracking by at least about 0.1 wt % ethylene, typically at least about 1 wt % ethylene, e.g., at least about 2 wt % ethylene.

In yet another embodiment of this aspect of the present invention, the normally liquid hydrocarbon component is added to the synthetic crude oil to increase the optimum coil outlet temperature (COT) by at least about 10° F., typically by at least about 70° F. For present purposes, the term "optimum coil outlet temperature" is defined as the maximum temperature at which an acceptable rate of radiant or quench coke formation is effected, except for pentane insoluble-containing feeds wherein an acceptable rate of coke formation is effected in the convection section. Typically, the optimum coil outlet temperature is that which provides a commercially acceptable runlength for the unit, and can be readily determined by those of skill in the art. Optimum coil outlet temperature can be determined by tube metal temperature increase rate. For example, a tube metal temperature increase of 125° F. is observed in a lab unit operating on 75 wt % hydrocrackate and 25 wt % syncrude. Factors affecting the optimum COT include furnace coking and downstream constraints. Generally, the optimum COT to make more ethylene (whose output peaks at much higher COT than propylene) is to raise COT past the temperature at which propylene production increases, to make more methane, more ethylene and less propylene. Coil outlet temperature is generally maintained below the point where ethylene make peaks.

In certain embodiments of this aspect of the invention, the mixture resulting from adding the normally liquid hydrocarbon component to the synthetic crude oil ranges from about 0.1 to about 99 parts by weight, typically from about 1 to about 9 parts by weight, e.g., from about 1 to about 3 parts by weight of normally liquid hydrocarbon component to each part by weight of synthetic crude oil.

In still other embodiments of this aspect, the wide boiling range aliquot contains from about 0.1 to about 10 parts by weight, typically from about 2 to about 3 parts by weight of the normally liquid hydrocarbon portion for each part by weight of the thermally cracked hydrocarbon liquid.

In another embodiment of this aspect of the invention, the cracking is steam cracking.

In yet another embodiment of this aspect, the synthetic crude oil is derived from shale and the normally liquid hydrocarbon component is derived from petroleum.

In another aspect, the present invention relates to a process for upgrading synthetic crude oil for cracking which synthetic crude oil is a hydroprocessed mixture of a) normally liquid hydrocarbon portion boiling in a range from about 50° to about 800° F., substantially free of resids, and b) thermally cracked hydrocarbon liquid boiling in a range from about 600° to about 1050° F., the synthetic crude oil boiling in a range of from about 73° to about 1077° F., containing greater than about 25 wt % aromatics, greater than about 25 wt % naphthenes, less than about 0.3 wt % S, less than about 0.02 wt % asphaltenes, and substantially free of resids other than asphaltenes, which process comprises: adding to the synthetic crude oil a petroleum-derived normally liquid hydrocarbon component boiling in a range from about 100° to about 1050° F., which component i) provides a greater optimum coil outlet temperature for cracker furnace effluent than the synthetic crude oil cracked separately.

In an embodiment of this aspect, the normally liquid hydrocarbon component is added to the synthetic crude oil in an amount sufficient to increase at least one of A) cracked effluent temperature at a cracker furnace coil outlet by about 5° to about 150° F., and B) olefin yield resulting from cracking, as compared to the synthetic crude oil alone.

In yet another aspect, the present invention relates to a feedstock for cracking which comprises: 1) a hydroprocessed wide boiling range aliquot containing a) normally liquid hydrocarbon portion boiling in a range from about 50° to about 800° F., substantially free of resids, and b) thermally cracked hydrocarbon liquid boiling in a range from about 600° to about 1050° F., to provide a synthetic crude oil boiling in a range of from about 73° to about 1077° F., containing greater than about 25 wt % aromatics, greater than about 25 wt % naphthenes, less than about 0.3 wt % S, less than about 0.02 wt % asphaltenes, and substantially free of resids other than asphaltenes; and 2) normally liquid hydrocarbon component boiling in a range from about 100° to about 1050° F., which feedstock has a greater optimum coil outlet temperature during cracking than the synthetic crude oil alone.

In an embodiment of this aspect of the present invention, the normally liquid hydrocarbon component is present in an amount sufficient to increase at least one of A) cracked effluent temperature at a cracker furnace coil outlet by about 5° to about 150° F., and B) olefin yield resulting from cracking, as compared to that obtained using the synthetic crude oil alone.

Embodiments of this aspect can include those wherein the normally liquid hydrocarbon component is selected from the group consisting of light virgin naphtha, condensate, kerosene, distillate, heavy atmospheric gas oil, virgin gas oil, hydrotreated gofinate, and hydrocrackate. Typically, the normally liquid hydrocarbon component is selected from the group consisting of light virgin naphtha and gas oil. Alternately, the normally liquid hydrocarbon component is selected from the group consisting of hydrotreated light virgin naphtha and hydrotreated gas oil.

In certain embodiments of this aspect of the present invention, the synthetic crude oil has a pour point no greater than about 80° F., typically no greater than about 70° F., e.g., no greater than about 52° F., say, about −12° F. while the normally liquid hydrocarbon component has a pour point greater than about 50° F., say, greater than about 102° F., e.g., greater than about 120° F., and the feedstock for cracking has a pour point no greater than about 100° F., say, no greater than about 64° F., e.g., no greater than about 52° F.

Embodiments of this aspect of the invention can comprise the process wherein the feedstock for cracking comprises from about 1 to about 99 wt % normally liquid hydrocarbon component and from about 1 to about 75 wt % synthetic crude oil, typically from about 75 to about 25 wt % normally liquid hydrocarbon component and from about 75 to about 25 wt % synthetic crude oil.

In one embodiment of this aspect, the normally liquid hydrocarbon component is added to the synthetic crude oil in an amount sufficient to reduce the pour point of the feedstock for cracking. The pour point can be reduced by at least about 3° F., typically at least about 5° F., e.g., at least about 10° F.

Certain embodiments of this aspect of the invention include those wherein the normally liquid hydrocarbon portion is a virgin refinery feed selected from the group consisting of light virgin naphtha, condensate, kerosene, distillate, heavy atmospheric gas oil, and vacuum gas oil, and the thermally cracked hydrocarbon liquid is selected from the group consisting of thermally cracked very heavy crude and coker gas oil.

Other embodiments of this aspect include those wherein the normally liquid hydrocarbon portion is a hydrotreated refinery stream selected from the group consisting of gofinate and hydrocrackate, and the thermally cracked hydrocarbon liquid is selected from the group consisting of thermally cracked very heavy crude and coker gas oil.

In another embodiment, the normally liquid hydrocarbon portion comprises light virgin naphtha condensate, and the thermally cracked hydrocarbon liquid comprises thermally cracked very heavy crude.

Additional embodiments of this aspect of the invention include those wherein the synthetic crude oil contains no greater than about 0.1 wt % S, e.g., no greater than about 0.05 wt % S.

In still other embodiments of this aspect, the normally liquid hydrocarbon component is present in the feedstock for cracking in an amount sufficient to provide an optimum coil outlet temperature of the cracker furnace for the resulting mixture which is increased by at least about 20° F., typically at least about 50° F., e.g., at least about 70° F., over the optimum coil outlet temperature of a comparable cracker furnace for synthetic crude oil alone.

In another embodiment of this aspect of the invention, the normally liquid hydrocarbon component is present in the feedstock for cracking in an amount sufficient to increase the hot cracked effluent temperature at the coil outlet of the cracker furnace to the optimum coil outlet temperature for the normally liquid hydrocarbon component. Typically, the normally liquid hydrocarbon component is present in the feedstock for cracking in an amount sufficient to increase severity by at least about 0.05 C3=/C1 for each 5° F. increase in coil outlet temperature (with ratio decreasing as COT and severity is increased), e.g., in an amount sufficient to increase severity by at least 0.03 C3=/C1 for each 5° F. increase in coil outlet temperature.

In still another embodiment of this aspect, the normally liquid hydrocarbon component is present in the feedstock for cracking in an amount sufficient to reduce coke make by at least about 10 wt %, typically at least about 20 wt %, e.g., at least about 35 wt %, over coke make for the synthetic crude oil alone.

In another embodiment of this aspect of the invention, the normally liquid hydrocarbon component is present in the feedstock for cracking in an amount sufficient to increase olefin yield from cracking by at least about 0.1 wt % ethylene, typically at least about 1 wt % ethylene, e.g., at least about 2 wt % ethylene, over olefin yield for the synthetic crude oil alone.

In certain embodiments of this aspect of the invention, the feedstock for cracking ranges from about 0.1 to about 99 parts by weight, typically from about 1 to about 9 parts by weight, e.g., from about 1 to about 3 parts by weight of normally liquid hydrocarbon component to each part by weight of synthetic crude oil.

In still other embodiments of this aspect, the wide boiling range aliquot contains from about 0.1 to about 10 parts by weight, typically from about 2 to about 3 parts by weight of the normally liquid hydrocarbon portion for each part by weight of the thermally cracked hydrocarbon liquid.

DETAILED DESCRIPTION

The present invention provides a process for cracking a synthetic crude oil-containing feedstock. Synthetic crude oils suitable for use in the present invention are prepared by i) hydroprocessing a wide boiling range aliquot containing a) normally liquid hydrocarbon portion boiling in a range from about 50° to about 800° F., substantially free of resids, and b) thermally cracked hydrocarbon liquid boiling in a range from about 600° to about 1050° F. For purposes of the present invention, the term "normally liquid" refers to a material that is substantially liquid under ambient conditions, say, temperatures ranging from about 32° F. to about 212° F., at about atmospheric pressure.

As used herein, non-volatile (non-distillable) components, or resids, are the fraction of a hydrocarbon feed with a nominal boiling point above 590° C. (1100° F.) as measured by ASTM D-6352-98 or D-2887. Non-volatiles include coke precursors, which are large, condensable molecules that condense in the vapor, and then form coke under the operating conditions encountered during cracking processes including hydrocracking, catalytic cracking, thermal cracking or steam cracking. For present purposes, the term "substantially free of resids" means containing less than about 70 wppm resids, preferably less than about 20 wppm resids. Given the resid-based coking problems associated with using heavier feeds in cracking processes, synthetic crude oils lacking resids are regarded with particular interest as a cracking feedstock, especially steam cracking. Asphaltenes, which may be present in resids, are n-heptane insoluble components. For present purposes, asphaltene content of a sample can be determined by well-known analytic techniques, e.g., ASTM D6560 (Standard Test for Determination of Asphaltenes (Heptane Insolubles) in Crude Petroleum and Petroleum Products), or ASTM D3270 (Standard Test Method for n-Heptane Insolubles).

Synthetic crude oil or "syncrude" is typically a synthetic blend of non-resid containing virgin liquids that have been combined with thermally cracked liquid products where the combined stream is subjected to hydroprocessing, i.e., hydrogenating, hydrotreating, or hydrocracking. Suitable hydroprocessing conditions include a temperature in the range of about 392° to about 896° F. (200°0 to about 480° C.), and a pressure in the range of from about 100 to about 3045 psig (690-21,000 kPa), e.g., 870 psig (6,000 kPa). The amount of hydrogen added may be from about 500 to about 5000, e.g., 2000, standard cubic feet (about 90-900 $Nm^3/m^3$) per barrel of feed.

Typically, the hydroprocessing is carried out under hydrotreating conditions. Typical hydrotreating conditions vary over a wide range. In general, the overall LHSV is about 0.25 to 2.0, preferably about 0.5 to 1.0. The hydrogen partial pressure is greater than about 200 psig, preferably ranging from about 500 psig to about 2000 psig. Hydrogen recirculation rates are typically greater than 50 SCF/Bbl, and are preferably between 1000 and 5000 SCF/Bbl. Temperatures range from about 300° to about 750° F., preferably ranging from about 450° F. to about 600° F. The resulting synthetic crude oil is a liquid boiling in a range of from about 73° to about 1070° F., containing greater than about 25 wt % aromatics, greater than about 25 wt % naphthenes, less than about 0.3 wt % S, less than about 0.02 wt % asphaltenes, and substantially free of resids other than asphaltenes.

Suitable synthetic crude oils are commercially available. Sincor crude is a heavy non-virgin Venezuelan crude. Syncrude 319 is a heavy non-virgin Canadian crude. Both of these have been processed to provide a full range crude with a gas oil endpoint. Such processing comprises removing heavy tail fraction by distillation, feeding the heavy tail fraction to a coker to provide a coker gas oil, blending the coker gas oil from the heavy tail with distilled bottom fraction, and hydroprocessing the resulting gas oil/bottoms blend to reduce olefins content. The properties of Sincor crude (Venezuelan) and Syncrude 319 (Canadian) are set out below in TABLE 1.

TABLE 1

FEED PROPERTIES

| | Sincor (Venezuela) | SynCrude 319 (Canadian) |
|---|---|---|
| Sp Gravity 60° F. | 0.8735 | 0.873 |
| True Boiling Curve ° F. | | |
| IBP | 73 | 38 |
| wt % | | |
| 5% | 240 | 177 |
| 10% | 331 | 271 |
| 20% | 440 | 416 |
| 30% | 512 | 497 |
| 40% | 571 | 558 |
| 50% | 623 | 610 |
| 60% | 674 | 663 |
| 70% | 730 | 719 |
| 80% | 790 | 779 |
| 90% | 865 | 851 |
| 95% | 924 | 906 |
| 100% | 1052 | 1029 |

Suitable feed for admixing with the synthetic crude oil to improve operability during cracking is a normally liquid hydrocarbon component boiling in a range from about 100° to about 1050° F. Heavy aromatic gas oil (HAGO) is especially suited to this use in the present invention. HAGO can be obtained as a bottom side stream off an atmospheric pipestill. Properties of HAGO are set out below in TABLE 2.

TABLE 2

HEAVY AROMATIC GAS OIL PROPERTIES

| | |
|---|---|
| Specific Gravity | 0.8671 |
| Boiling Curve | BP (° F.) |
| IBP | 355.3 |
| 10% | 554.2 |

TABLE 2-continued

| HEAVY AROMATIC GAS OIL PROPERTIES | |
|---|---|
| 20% | 609.1 |
| 30% | 645.8 |
| 40% | 668.1 |
| 50% | 685.8 |
| 60% | 703.5 |
| 70% | 722.1 |
| 80% | 744 |
| 90% | 774.2 |
| FBP | 878.1 |

Another suitable feed for admixing with the synthetic crude oil to improve operability during cracking is a hydrocrackate of higher pour point than the synthetic crude oil. Characteristics of such a high pour hydrocrackate (110° F. Pour) are set out below in TABLE 3.

TABLE 3

| HIGH POUR (110° F.) HYDROCRACKATE CHARACTERISTICS | |
|---|---|
| Feed Name | Rotterdam Hydrocrackate (SOR) |
| Feed Properties | |
| P (n-paraffins) | 7.5 |
| I (iso-paraffins) | 23.8 |
| N (napthenics) | 55.3 |
| Hydrogen content (wt %) | 13.3 |
| Specific gravity | 0.8674 |
| Sulfur content (wt %) | 0.004 |
| D-86 IBP (° F.) | 622 |
| D-86 BP10 (° F.) | 716 |
| D-86 IBP 30 (° F.) | 769 |
| D-86 IBP 50 (° F.) | 797 |
| D-86 IBP 70 (° F.) | 830 |
| D-86 IBP 90 (° F.) | 888 |
| D-86 FBP for Gas Oils, BP 95 for Naphthas | 981 |

In applying this invention, the hydrocarbon feedstock comprising a mixture of synthetic crude oil and normally liquid hydrocarbon component may be initially heated by indirect contact with flue gas in a first convection section tube bank of the pyrolysis furnace before mixing with a dilution fluid, e.g., steam. Preferably, the temperature of the heavy hydrocarbon feedstock is from about 150° to about 260° C. (300° to 500° F.) before mixing with the dilution fluid.

Following mixing with the primary dilution steam stream, the mixture stream may be heated by indirect contact with flue gas in a first convection section of the pyrolysis furnace before being flashed. Preferably, the first convection section is arranged to add the primary dilution steam stream, between subsections of that section such that the hydrocarbon feedstock can be heated before mixing with the fluid and the mixture stream can be further heated before being flashed.

The temperature of the flue gas entering the first convection section tube bank is generally less than about 815° C. (1500° F.), for example, less than about 705° C. (1300° F.), such as less than about 620° C. (1150° F.), and preferably less than about 540° C. (1000° F.).

Dilution steam may be added at any point in the process, for example, it may be added to the hydrocarbon feedstock before or after heating, to the mixture stream, and/or to the vapor phase. Any dilution steam stream may comprise sour steam. Any dilution steam stream may be heated or superheated in a convection section tube bank located anywhere within the convection section of the furnace, preferably in the first or second tube bank.

The mixture stream may be at about 315° to 540° C. (600° to about 1000° F.) before introduction to the vapor/liquid separator or flash apparatus, e.g., knockout drum, and the flash pressure may be about 275 to about 1375 kPa (40 to 200 psia). Following the flash, 50 to 98% of the mixture stream may be in the vapor phase. An additional separator such as a centrifugal separator may be used to remove trace amounts of liquid from the vapor phase. The vapor phase may be heated to above the flash temperature before entering the radiant section of the furnace, for example, to about 425° to 705° C. (800 to 1300° F.). This heating may occur in a convection section tube bank, preferably the tube bank nearest the radiant section of the furnace.

A transfer line exchanger can be used to produce high pressure steam which is then preferably superheated in a convection section tube bank of the pyrolysis furnace, typically to a temperature less than about 590° C. (1100° F.), for example, about 455 to about 510° C. (850° to 950° F.) by indirect contact with the flue gas before the flue gas enters the convection section tube bank used for heating the heavy hydrocarbon feedstock and/or mixture stream. An intermediate desuperheater may be used to control the temperature of the high pressure steam. The high pressure steam is preferably at a pressure of about 4240 kPa (600 psig) or greater and may have a pressure of about 10450 to about 13900 kPa (1500 to 2000 psig). The high pressure steam superheater tube bank is preferably located between the first convection section tube bank and the tube bank used for heating the vapor phase.

The gaseous effluent from the coil outlet of the radiant section of the steam cracker furnace can be subjected to direct quench, at a point typically between the furnace outlet and the separation vessel (primary fractionator) or tar knock-out drum. Such quench can be carried out in a secondary and/or tertiary transfer line exchanger as described above. The quench is effected by contacting the effluent with a liquid quench stream, in lieu of, or in addition to the treatment with transfer line exchangers. Where employed in conjunction with at least one transfer line exchanger, the quench liquid is preferably introduced within or at a point downstream of the transfer line exchanger(s). Suitable quench liquids include liquid quench oil, such as those obtained by a downstream quench oil knock-out drum, pyrolysis fuel oil and water, which can be obtained from various suitable sources, e.g., condensed dilution steam.

After passage through the direct quench and/or transfer line heat exchanger(s), the cooled effluent is fed to the separation vessel (a primary fractionator or at least one tar knock-out drum), wherein the condensed tar is separated from the effluent stream.

The gaseous overhead of the separation vessel is directed to a recovery train for recovering $C_2$ to $C_4$ olefins, inter alia.

The invention is illustrated by the following Examples which are provided for the purpose of representation and is not to be construed as limiting the scope of the invention. Unless stated otherwise, all percentages, parts, etc., are by weight.

EXAMPLE 1

Engineering calculations (COMPASS) which simulate processing synthetic crude alone and admixtures of synthetic crude with HAGO in accordance with this invention are conducted and compared with actual laboratory results. Reaction conditions include reactor temperature of 725° C. (measured at coil outlet), reactor pressure of about 50 kpag, steam/hydrocarbon ratio of 0.30 with severity (C3=/C1, i.e., weight ratio of propylene/methane) of about 1.5 and selectivity (C2=/C1, i.e., weight ratio of ethylene/methane) of about 1.6. Results for cracking Sincor and Syncrude 319 synthetic crudes alone, or in combination with heavy aromatic gas oil (75 parts synthetic crude oil/25 parts HAGO) in a commercial size furnace as described above show an increase in ethylene yield of about 2 wt %, reductions in radiant/quench coke make of about 10 wt % and increase in optimum coil outlet temperature by about 125° F.

EXAMPLE 2

Example 1 was repeated except a high pour hydrocrackate with a pour point of 110° F. was substituted for the HAGO. The synthetic crudes Sincor and Syncrude 319 exhibit low pour points of −12° F. Results show an increase in ethylene yield of about 2 wt %, reductions in radiant/quench coke make of about 10 wt % and increase in optimum coil outlet temperature by about 125° F. The low pour syncrude/high pour hydrocrackate mixtures exhibit relatively low pour points of 80° F., which makes them suitable for use without heated tanks or lines.

Although the present invention has been described in considerable detail with reference to certain preferred embodiments, other embodiments are possible, and will become apparent to one skilled in the art. Therefore, the spirit and scope of the appended claims should not be limited to the descriptions of the preferred embodiments contained herein.

What is claimed is:

1. A process for cracking a synthetic crude oil-containing feedstock comprising:

i) hydroprocessing a wide boiling range aliquot containing a) normally liquid hydrocarbon portion boiling in a range from about 50° to about 800° F., substantially free of resids, and b) thermally cracked hydrocarbon liquid boiling in a range from about 600° to about 1050° F., to provide a synthetic crude oil boiling in a range from about 73° to about 1070° F., containing greater than about 25 wt % aromatics, greater than about 25 wt % naphthenes, less than about 0.3 wt % S, less than about 0.02 wt % asphaltenes, and substantially free of resids other than asphaltenes;

ii) adding to the synthetic crude oil a normally liquid hydrocarbon component boiling in a range from about 100° to about 1050° F. wherein the normally liquid hydrocarbon component is selected from the group consisting of light virgin naphtha, condensate, kerosene, distillate, hydrotreated gas oil, and hydrocrackate; and iii) cracking the mixture resulting from ii) in a cracker furnace comprising a radiant coil outlet to provide a cracked effluent, wherein the cracking is carried out under conditions sufficient to effect a radiant coil outlet temperature which is greater than the optimum radiant coil outlet temperature for cracking the synthetic crude oil separately.

2. The process of claim 1, wherein the normally liquid hydrocarbon component has a greater optimum radiant coil outlet temperature than the synthetic crude oil.

3. The process of claim 2, wherein the normally liquid hydrocarbon component is added to the synthetic crude oil in an amount sufficient to increase at least one of A) cracked effluent temperature at the coil outlet by from about 5° to about 150° F., and B) olefin yields resulting from the cracking, as compared to the synthetic crude oil alone.

4. The process of claim 1, wherein the normally liquid hydrocarbon component is selected from the group consisting of hydrotreated light virgin naphtha and hydrotreated gas oil.

5. The process of claim 1, wherein the synthetic crude oil has a pour point no greater than about 80° F., the normally liquid hydrocarbon component has a pour point greater than about 102° F., and the mixture resulting from ii) has a pour point no greater than about 100° F.

6. The process of claim 5, wherein the synthetic crude oil has a pour point no greater than about 52° F., the normally liquid hydrocarbon component has a pour point greater than about 120° F., and the mixture resulting from ii) has a pour point no greater than about 64° F.

7. The process of claim 6, wherein the mixture comprises about 75 wt % hydrocrackate and about 25 wt % synthetic crude oil.

8. The process of claim 1, wherein the normally liquid hydrocarbon component is added to the synthetic crude oil in an amount sufficient to reduce the pour point of the mixture resulting from ii).

9. The process of claim 1, wherein the normally liquid hydrocarbon portion is a virgin refinery feed selected from the group consisting of light virgin naphtha, condensate, kerosene, distillate, heavy atmospheric gas oil, and vacuum gas oil, and the thermally cracked hydrocarbon liquid is selected from the group consisting of thermally cracked very heavy crude and coker gas oil.

10. The process of claim 1, wherein the normally liquid hydrocarbon portion is a hydrotreated refinery stream selected from the group consisting of gas oil and hydrocrackate, and the thermally cracked hydrocarbon liquid is selected from the group consisting of thermally cracked very heavy crude and coker gas oil.

11. The process of claim 1, wherein the normally liquid hydrocarbon portion comprises light virgin naphtha condensate, and the thermally cracked hydrocarbon liquid comprises thermally cracked very heavy crude.

12. The process of claim 1, wherein the hydroprocessing is hydrotreating.

13. The process of claim 1, wherein the hydroprocessing is hydrogenating.

14. The process of claim 1, wherein the hydroprocessing is hydrocracking.

15. The process of claim 1, wherein the synthetic crude oil contains no greater than about 0.1 wt % S.

16. The process of claim 1, wherein the synthetic crude oil contains no greater than about 0.05 wt % S.

17. The process of claim 1, wherein the normally liquid hydrocarbon component is added to the synthetic crude oil in an amount sufficient to provide an optimum coil outlet temperature of the cracker furnace for the resulting mixture which is increased by at least about 70° F. over the optimum coil outlet temperature of the cracker furnace for synthetic crude oil alone.

18. The process of claim 1, wherein the normally liquid hydrocarbon component is added to the synthetic crude oil in an amount sufficient to increase the hot cracked effluent temperature at the coil outlet of the cracker furnace to the optimum coil outlet temperature for the normally liquid hydrocarbon component.

19. The process of claim 1, wherein the normally liquid hydrocarbon component is added to the synthetic crude oil in an amount sufficient to increase severity by at least about 0.05 C3=/C1 for each 5° F. increase in coil outlet temperature.

20. The process of claim 1, wherein the normally liquid hydrocarbon component is added to the synthetic crude oil in an amount sufficient to increase severity by at least about 0.03 C3=/C1 for each 5° F. increase in coil outlet temperature.

21. The process of claim 1, wherein the normally liquid hydrocarbon component is added to the synthetic crude oil in an amount sufficient to reduce coke make by at least about 10 wt %.

22. The process of claim 1, wherein the normally liquid hydrocarbon component is added to the synthetic crude oil in an amount sufficient to increase olefin yields from cracking by at least about 1 wt % ethylene.

23. The process of claim 22, wherein the normally liquid hydrocarbon component is added to the synthetic crude oil to increase the optimum coil outlet temperature by at least about 70° F.

24. The process of claim 1, wherein the mixture resulting from adding the normally liquid hydrocarbon component to the synthetic crude oil ranges from about 0.1 to about 99 parts by weight of normally liquid hydrocarbon to each part by weight of synthetic crude oil.

25. The process of claim 24, wherein the mixture resulting from adding the normally liquid hydrocarbon component to the synthetic crude oil ranges from about 1 to about 3 parts by weight of normally liquid hydrocarbon to each part by weight of synthetic crude oil.

26. The process of claim 1, wherein the wide boiling range aliquot contains from about 1 to about 10 parts by weight of the normally liquid hydrocarbon portion for each part by weight of the thermally cracked hydrocarbon liquid.

27. The process of claim 1, wherein the wide boiling range aliquot contains from about 2 to about 3 parts by weight of the normally liquid hydrocarbon portion for each part by weight of the thermally cracked hydrocarbon liquid.

28. The process of claim 1, wherein the cracking is steam cracking.

29. The process of claim 1, wherein the synthetic crude oil is derived from shale and the normally liquid hydrocarbon component is derived from petroleum.

30. A process for upgrading synthetic crude oil for cracking which synthetic crude oil is a hydroprocessed mixture of a) normally liquid hydrocarbon portion boiling in a range from about 50° to about 800° F., substantially free of resids, and b) thermally cracked hydrocarbon liquid boiling in a range from about 600° to about 1050° F., the synthetic crude oil boiling in a range from about 73° to about 1077° F., containing greater than about 25 wt % aromatics, greater than about 25 wt % naphthenes, less than about 0.3 wt % S, less than about 0.02 wt % asphaltenes, and substantially free of resids other than asphaltenes, which process comprises:

adding to the synthetic crude oil a petroleum-derived normally liquid hydrocarbon component boiling in a range from about 100° to about 1050° F. wherein the normally liquid hydrocarbon component is selected from the group consisting of light virgin naphtha, condensate, kerosene, distillate, hydrotreated gas oil, and hydrocrackate, which component i) provides a greater optimum coil outlet temperature for cracker furnace effluent than the synthetic crude oil cracked separately.

31. The process of claim 30, wherein the normally liquid hydrocarbon component is added to the synthetic crude oil in an amount sufficient to increase at least one of A) cracked effluent temperature at a cracker furnace coil outlet by about 5° to about 150° F., and B) olefin yield resulting from cracking, as compared to the synthetic crude oil alone.

* * * * *